US008113611B2

(12) United States Patent
Bergstedt et al.

(10) Patent No.: US 8,113,611 B2
(45) Date of Patent: Feb. 14, 2012

(54) MICRO-FLUID EJECTION APPARATUS SIGNAL COMMUNICATION DEVICES AND METHODS

(75) Inventors: Steven Wayne Bergstedt, Winchester, KY (US); John Glenn Edelen, Versailies, KY (US)

(73) Assignee: Lexmark International, Inc., Lexington, KY (US)

( * ) Notice: Subject to any disclaimer, the term of this patent is extended or adjusted under 35 U.S.C. 154(b) by 256 days.

(21) Appl. No.: 12/336,642

(22) Filed: Dec. 17, 2008

(65) Prior Publication Data

US 2009/0097084 A1 Apr. 16, 2009

Related U.S. Application Data

(62) Division of application No. 11/278,261, filed on Mar. 31, 2006, now Pat. No. 7,631,953.

(51) Int. Cl.
*B41J 29/38* (2006.01)

(52) U.S. Cl. ..... 347/5; 347/10; 347/57; 347/59

(58) Field of Classification Search ..... 347/5, 9–12, 347/50, 57–59

See application file for complete search history.

(56) References Cited

U.S. PATENT DOCUMENTS 5,216,667 A * 6/1993 Chu et al. ..... 370/276
5,578,939 A * 11/1996 Beers et al. ..... 326/30
5,987,543 A * 11/1999 Smith ..... 710/70
6,070,211 A * 5/2000 Neal et al. ..... 710/106
6,312,080 B1 * 11/2001 De Roos et al. ..... 347/14
6,334,668 B1 * 1/2002 Isamoto ..... 347/57
6,507,225 B2 * 1/2003 Martin et al. ..... 327/108
6,519,328 B1 * 2/2003 Rumbaugh ..... 379/93.06
6,685,289 B2 * 2/2004 Anderson et al. ..... 347/5
6,791,356 B2 * 9/2004 Haycock et al. ..... 326/82
6,842,037 B1 * 1/2005 Gradl ..... 326/30
7,174,143 B1 * 2/2007 Turvey ..... 455/226.1
7,436,214 B2 * 10/2008 Chang et al. ..... 326/82
2002/0097285 A1 * 7/2002 Ishizaki ..... 347/9
2003/0025740 A1 * 2/2003 Rehmann et al. ..... 347/5
2005/0110515 A1 * 5/2005 Ju et al. ..... 326/14

* cited by examiner

*Primary Examiner* — Matthew Luu
*Assistant Examiner* — Henok Legesse

(57) ABSTRACT

Micro-fluid ejection apparatuses and devices, and methods related to communication in and with the same. One such micro-fluid ejection apparatus includes a controller configured to generate a data signal, and a transmitter configured to convert the data signal to a current signal. The apparatus further includes a conductor capable of carrying the current signal, and a receiver configured to receive the current signal from the conductor and to convert the current signal to a second data signal. The micro-fluid ejection apparatus is configured to operate on the second data signal. In one embodiment, the micro-fluid ejection apparatus may be a printing apparatus, such as an inkjet printing apparatus. In some embodiments, the current signal comprises a pair of corresponding differential current signals and/or current transfer logic signals offset from a base amperage level. In some embodiments, the transmitter and controller are provided within a main printing control board, while the receiver is provided within a printhead cartridge or a printhead carrier, and the operation comprises a printing function.

3 Claims, 4 Drawing Sheets

MICRO-FLUID EJECTION APPARATUS SIGNAL COMMUNICATION DEVICES AND METHODS

CROSS REFERENCE TO RELATED APPLICATION

Pursuant to 37 C.F.R. §1.78, this application is a divisional and claims the benefit of the earlier filing date of application Ser. No. 11/278,261 filed Mar. 31, 2006 now U.S. Pat. No. 7,631,953 entitled "Micro-Fluid Ejection Apparatus Signal Communication Devices and Methods."

TECHNICAL FIELD

The invention relates generally to micro-fluid ejection apparatus. More particularly, the invention relates to improved signal communication methods and apparatuses in micro-fluid ejection apparatuses.

BACKGROUND

Many micro-fluid ejection apparatuses are controlled by data signals, such as those which cause fluid, such as ink for example, to be applied to a medium such as paper. An ink jet printing apparatus, for instance, may include a micro-fluid ejection head, such as a printhead having actuators that are controlled by data signals. In particular, the printhead can reside on a micro-fluid ejection device, such as a printhead cartridge having an ink reservoir and an actuator chip. The chip can include nozzles with corresponding actuators, such as heaters. A main electronic controller within the printing apparatus can transmit voltage signals to the printhead. If standard CMOS voltage signals are utilized, typically a 3.3 V signal represents a digital 1 while 0V represents a digital 0. The voltage signals cause the heaters to heat the ink held in a chamber at the nozzles, which in turn causes the ink to be ejected from the nozzles onto the print medium at selected ink dot locations within an image area. In response to the signals, a carrier might move the printhead relative to the medium, while the ink dots are jetted onto selected pixel locations (although in other embodiments, a stationary printhead, such as a page-wide printhead, might be used).

Users of printing apparatuses, such as the above, continue to demand higher quality images and text which require higher resolution, or, in other words, that more dots be printed per unit area. Users also continue to demand higher print speeds, such that pages can be printed faster. In order to decrease the time required to print an image or increase the resolution of a printed image, larger and larger numbers of nozzles are being placed on modern ink jet printhead cartridges. Moreover, speed can be increased by increasing the power of the circuit driving the voltage signals being delivered from the main controller to the printhead.

However, increased number of nozzles and increased power can also increase the electromagnetic interference (EMI) generated by the ejection apparatus. Increased EMI can interfere with, for example, internal printing components and electronics, as well as external devices that may be located near the ejection apparatus. In fact, the Federal Communications Commission establishes standards on the limits of EMI that may be emitted from a device. Accordingly, in order to stay within the EMI standards, power levels are often limited, thereby limiting the speed at which data can be transmitted and therefore the speed at which the apparatus may print. While improved techniques have been developed for transmitting voltages in micro-fluid ejection apparatus, such as via lower voltage differential signaling, such techniques can still create high levels of EMI.

Thus, there is a need to increase the speed of data communication in a micro-fluid ejection apparatus, such as the communication between the printer electronics of a printing apparatus and a printhead cartridge, while controlling EMI within acceptable levels.

SUMMARY

According to one embodiment, a micro-fluid ejection apparatus is provided comprising a controller configured to generate a data signal, and a transmitter configured to convert the data signal to a current signal. The apparatus further includes a conductor capable of carrying the current signal, and a receiver configured to receive the current signal from the conductor and to convert the current signal to a second data signal. The micro-fluid ejection apparatus is configured to operate on the second data signal.

In some embodiments, the current signal can comprise a pair of corresponding differential current signals that are offset from a base amperage level. In some embodiments, the transmitter and controller are provided with a main printing control board, while the receiver is provided with a printhead cartridge or carrier, the cartridge/carrier and control board being connected by a flexible cable carrying the conductor and the operation being the transfer of a printing substance to a print media.

According to another embodiment, a method for communicating in a micro-fluid ejection apparatus is provided. The method comprises producing a data signal, converting the data signal to a current signal, and transmitting the current signal over a conductor. The method further comprises receiving the current signal from the conductor, and converting the current signal to a second data signal. The micro-fluid apparatus is configured to operate on the second data signal.

In some embodiments, the current signal can comprise a current transfer logic signal or a pair of differential current signals.

According to one embodiment, a micro-fluid ejection apparatus is provided comprising a controller configured to generate a data signal, a current differential transmitter provided at the controller and configured to generate a pair of offset current signals representing the data signal, and a cable in communication with the transmitter and capable of transmitting the current signals. The apparatus further comprises a micro-fluid ejection head in communication with the cable and configured to cause ejection of a fluid, and a current differential receiver provided with the head or a carrier, and configured to receive the current signals from the cable and to convert the signals to a data signal, such as one that can be used to selectively cause ejection of a fluid.

According to another embodiment, a micro fluid ejection device is provided comprising a nozzle configured to allow the fluid to be ejected, and an actuator configured to cause the fluid to eject from the nozzle. The device further includes a differential current receiver configured to receive differential current signals from electronics remote from the device and to convert the differential current signals to a signal for use by the ejection device.

BRIEF DESCRIPTION OF THE DRAWINGS

While the specification concludes with claims particularly pointing out and distinctly claiming the present invention, it is believed the same will be better understood from the following description of examples taken in conjunction with the accompanying drawings wherein like numerals indicate corresponding elements and wherein:

DETAILED DESCRIPTION OF ILLUSTRATIVE EMBODIMENTS

Generally, embodiments discussed herein relate to the communication of signals in a printing apparatus, such as an inkjet printer or multi-function apparatus, using current signals. In some embodiments, the current signals comprise a pair of differential current signals, such as current transfer logic signals for example, and communicate data between a main printer controller board and a printhead. In some embodiments, high data throughput is achieved while maintaining acceptable EMI levels.

Figure 1:
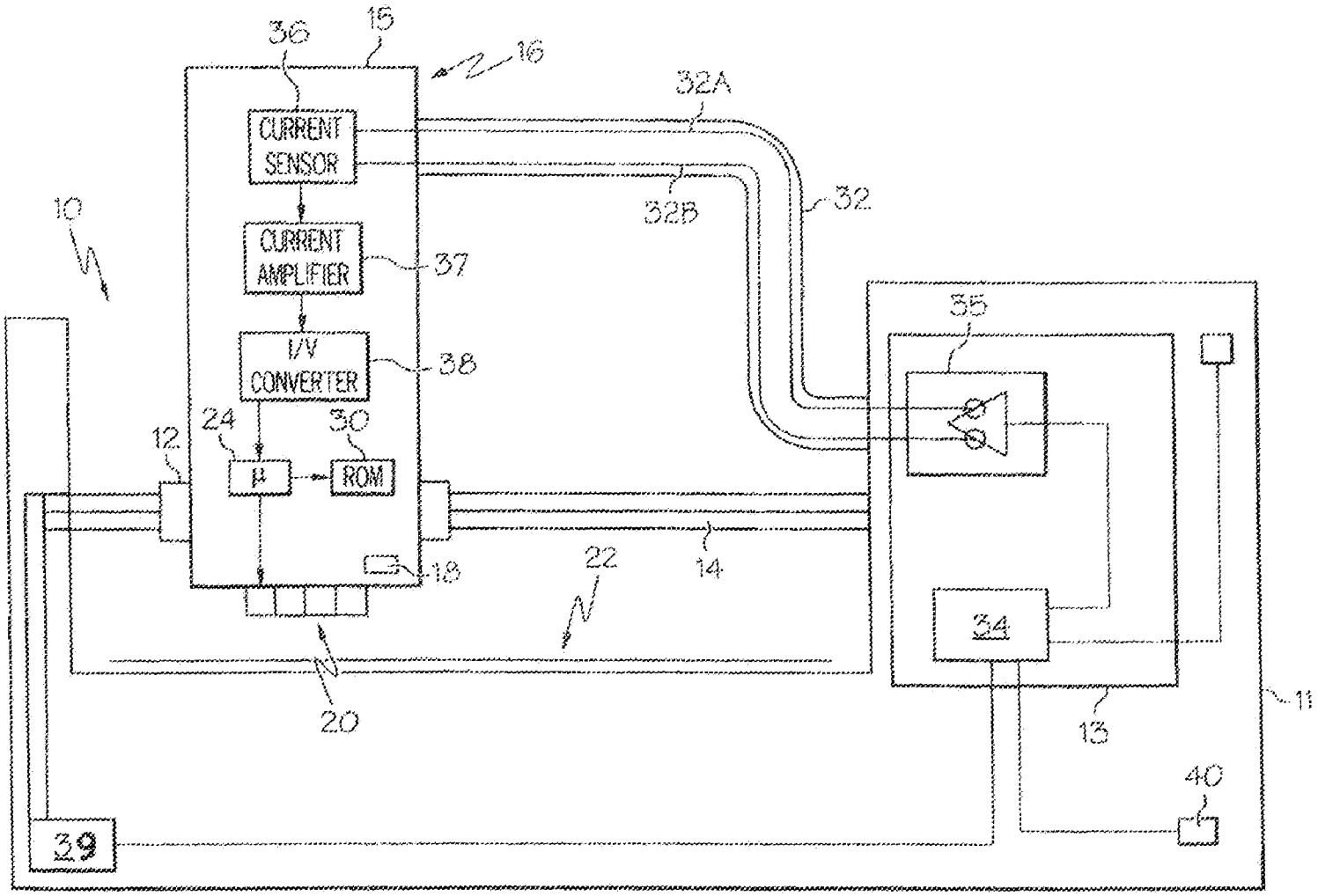
FIG. 1 is a schematic diagram of a micro-fluid ejection apparatus utilizing current signal communication according to one embodiment.

Aspects of the invention, however, can also be applicable to various other micro-fluid ejection apparatus, such as medical devices and apparatus for printing electronic components, for example. Nevertheless, the embodiments presented herein will primarily be discussed in the context of an ink jet printing apparatus, such as an ink jet printer. Accordingly, as shown in FIG. 1, an ink jet printer 10 can utilize a printhead carrier 12 that is movably mounted on a support member 14 (although other embodiments might be directed to a stationary printhead, for example). A printhead cartridge 16 is installed on the printhead carrier 12. While a single printhead cartridge 16 is shown, it will be readily apparent to those skilled in the art that a color ink jet printer, for example, may utilize multiple printhead cartridges, each having an ink reservoir containing one of the primary colors selected from cyan, magenta, yellow, and black, or a single printhead cartridge containing a multi-color printhead and associated ink reservoirs for the primary colors. However, for purposes of simplicity, the printhead cartridge 16 in FIG. 1 is shown with a single ink reservoir 18 within the cartridge housing 15. In this example, ink is drawn from the ink reservoir 18 and expelled by a printhead 20 mounted on the printhead cartridge 16 onto a printing medium 22 such as paper. A printhead processing circuit 24 can be mounted in the printhead cartridge 16 that can control the operation of the printhead 20. This circuit 24 can include addressing logic, latches, drive circuitry, and/or other processor circuitry to process the signals received and control the firing of ink onto the print media.

In some embodiments, a printhead memory 30 can be used to store operating information and historical data for the printhead cartridge 16. This memory 30 can allow information to be associated with the printhead cartridge 16 such that if the printhead cartridge 16 is removed from the ink jet printer 10, the operating information and historical data remains associated with the printhead cartridge 16. The information and data associated with a printhead cartridge 16 can allow the printhead cartridge 16 to adapt its operating parameters to a wide variety of printing formats. The memory 30 and processing circuitry 24 can reside on one or more integrated circuit chips on the print cartridge 16, and, in some cases, on the printhead 20.

The printhead cartridge 16 can be coupled to the ink jet printer 10 through an electrical connection cable 32. This connection cable 32 allows a printer microprocessor 34 to communicate with the printhead processing circuit 24. The printer microprocessor 34 can communicate printing instructions and activation signals to the printhead microprocessing circuit 24 through electrical connections contained in the electrical connection cable 32. The cable 32 can comprise a ribbon cable or other flexible connector.

Actuators, such as heaters, piezoelectric elements, or micro-electromechanical (MEMs) devices, for example, may be provided on a substrate attached to the cartridge body 16 at the printhead 20 (e.g., the substrate of the printhead 20). The substrate may be etched to contain an ink via therethrough for flow of ink from within a reservoir or chamber in the cartridge 16 to the actuators. Although disclosed in this embodiment as being integral with the cartridge 16, in other embodiments, a reservoir or chamber 18 may be selectively removable with respect to the cartridge 16, and/or in fluid communication with the printhead 20 from a remote location (e.g., through the use of tubes and the like).

Remote from the cartridge 16 are main control electronics for the printer. These main control electronics can be included on a main printed circuit board 13 having an application specific integrated circuit including a printer microprocessor 34 and/or position controller located in the housing 11 of the printer 10. The printer microprocessor 34 controls the operation of the ink jet printer 10. In embodiments utilizing a movable carrier 12, a carrier position controller 39 moves the printhead carrier 12 in response to control signals received from the printer microprocessor 34. The printer microprocessor 34 also controls the expelling of ink drops from the actuators in the printhead 20 by sending data signals to the printhead 20 and the printhead microprocessing circuit 24 via the connection cable. The data signals can include electrical power signals as well as electrical signals representing nozzle addresses, nozzle banks, clock counts, memory reads, memory writes and/or firing signals. By controlling the position of the printhead carrier 12 and selectively expelling ink from the printhead 20, the printer microprocessor 34 can create, for example, a desired image on a printing medium 22 in response to signals received from an input device, such as a computer or memory, through an input port 40 coupled to the computer.

The printer microprocessor 34 can use a memory to store configuration information and operating parameter information that enables the microprocessor 34 to operate the printer 10 with a variety of different media formats that are compatible with different types of printhead cartridges 16. For example, printing may be desired on plain paper, photographic paper, coated paper, glossy photographic paper, polymeric films, and the like. The microprocessor 34 can coordinate information from the printhead memory 30 in order to select optimal operational parameters for printing on a selected print media in a desired print quality mode. Such operational parameters might include, but are not limited to, printhead scan speed, volume of ink ejected, printhead temperature, ink ejection velocity, print quality mode, and the like.

As shown in the example of FIG. 1, a data signal transmitted between the printer electronics and the printhead cartridge 16 is carried via a pair of wires 32A and 32B within the connection cable 32.

As shown in FIG. 1, in this embodiment, the primary printer electronics in the printer housing include a differential current transmitter 35. This transmitter converts the voltage signals from the processor 34, which ordinarily would be delivered to the printhead addressing circuitry 24, into a pair of corresponding currents that generally differ or are offset by an equal amount from a base level. For example, if the base level were 100 microamps, to represent a logical one, the first current signal on the first conductor 32A might be 150 microamps and the second current signal on the second conductor 32B might be 50 microamps. Then, to represent a logical zero, these corresponding currents can be switched: the first current signal can be switched to 50 microamps and the second current signal to 150 microamps The current signals are then provided over the cable 32 to the printhead cartridge 16. At the printhead cartridge 16, the signals are converted back to voltage levels for use by the processor 24 in carrying out the firing of the heater elements on the printhead 20, for example. In this embodiment, the receiver comprises a low impedance current receive circuit that includes a current sensing circuit 36 which senses the current levels and provides a current to a current amplification circuit 37. The amplification circuit 37 amplifies the current levels and provides them to a current-to-voltage converter circuit 38. The converter circuit 38 then provides voltage signals for use by the processing circuitry 24 or other similar logic circuitry in carrying out control of the depositing of ink from the printhead 20. In this embodiment, a resistor need not be utilized at the printhead receiver side. The data transmission in this embodiment can occur at 100 MHz or greater speeds while still maintaining acceptable EMI levels. Generated EMI may be 20 dB less than generated using standard TTL technology.

Accordingly, in FIG. 1, a micro-fluid ejection apparatus such as printer 10 includes a controller 34 which provides a formatted data signal from the printer ASIC. The data is represented by CMOS voltage levels, for example. The current mode driver 35 converts the voltage levels to a pair of differential current signals which are transmitted across the printer ribbon cable 32 to the printhead cartridge 16. The data is received at the current mode receiver components on the cartridge 16 and/or the carrier 12. The receiver 36/37/38 and processing circuitry 24/30 can be either discrete components on the printhead carrier 12 (e.g., a card mounted on the carrier) or can be incorporated in the printhead 20 itself. The data is converted by converter 38 back to CMOS voltages and transmitted to the logic located on or near the printhead. While this example shows a unidirectional communication, it should be understood that the current transmitter and current receiver could be transceivers and that bi-directional current differential communication can therefore be utilized. The current transfer logic utilized in this embodiment can be transmitted on relatively long cables with little attenuation and with substantially constant current. For example, a 250 MHz signal may be transmitted on a 24 inch flex cable with less EMI than a low voltage differential signaling system.

Figure 2:
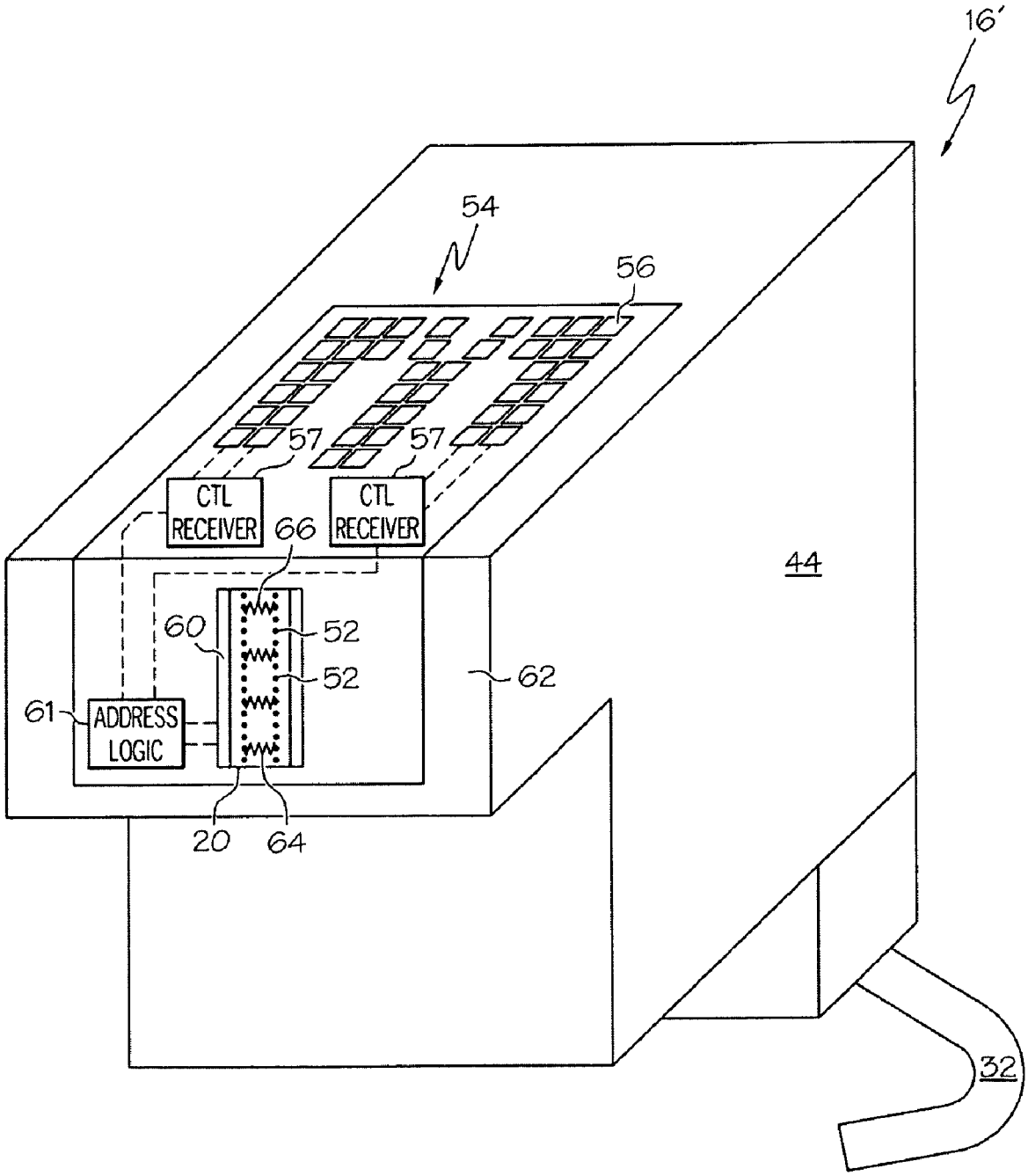
FIG. 2 is perspective view of a micro-fluid ejection device, in the form of a printhead cartridge, utilizing current signals according to an embodiment.

Referring now to FIG. 2, a more detailed pictorial representation of an example of a micro-fluid ejection device in the form of a printhead cartridge 16' constructed in accordance with one embodiment is shown. The printhead cartridge 16' in this example consists of a cartridge body 44 that includes an ink reservoir formed therein for storing a consumable ink supply. A tape automated bonding (TAB) circuit or flexible circuit 54 can be mounted on the cartridge body 44. The TAB circuit or flexible circuit 54 can be constructed of a flexible, electrically insulating, heat resistant material such as a polyimide film. The TAB circuit or flexible circuit 54 also contains a series of electrical contacts 56 that provide electrical connections between the printhead cartridge 16' and an ink jet printer, for example, when the printhead cartridge 16' is installed in a printhead carrier 12. Conductive leads 58 imbedded in the tab circuit 54 electrically connect each of the electrical contacts 56 to a heater chip 60 of the printhead 20.

In this example, the heater chip 60 is bonded to the tab circuit 54 on a side section 62 of the printhead cartridge 16' that faces the printing medium 22 when the cartridge 16' is installed on the carrier. The heater chip 60 can be constructed of thin-film resistors positioned on, for example, a silicon or ceramic substrate. For example, the printhead 20 can be constructed of two or more separate substrates or a single large substrate containing multiple ink feed slots therein. A nozzle plate 64 can be positioned over the substrate 60 such that the individual nozzles 52 on the nozzle plate 64 align with actuators 66, such as heater resistors or piezoelectric actuators or other actuators, on the chip 60. An ink passage can provide ink from inside the cartridge body 44 to the actuators 66 on the chip 60.

With reference again to FIGS. 1 and 2, the function of the TAB circuit or flexible circuit 54 is to provide electrical interconnection between the electronics of the printer and the actuators contained on chip 60 when the printhead cartridge 16 is mounted in the printhead carrier 12 of an ink jet printer, such as printer 10. A demultiplexer, microprocessor, firing circuit, or related addressing control circuitry 61 can be provided on the TAB circuit or flexible circuit 54 to decode the information and activate the selected actuators 66. Connections on the printhead carrier 12 can also be provided to couple with the electrical contacts 56 to provide power and logic from the printer microprocessor 34.

As mentioned above, according to some aspects, one or more of these logic or address signals can be transmitted from the printer as a pair of current signals. As shown in the embodiment of FIG. 2, current transfer logic receiver circuits 57 are provided at the printhead for each pair of current signals received. The receiver circuits 57 convert the current levels of each pair of corresponding current signals to a voltage signal to be used by the addressing circuitry 61 on the printhead cartridge 16. The addressing circuitry 61 then includes logic to cause the firing of the appropriate heaters 66 based upon the voltage signals it receives, such as by using conventional or future addressing techniques.

Examples of circuitry for transmitting and receiving data in a printing apparatus according to one embodiment will now be described. A current driver circuit may be used in the printer electronics to receive the data signal, as a voltage from the other printer controller electronics. The data signal can comprise a clock signal, a primitive print signal, a printer firing or select signal, a signal function or other signal utilized in the printer, and is then converted to a pair of differential currents.

The two currents are then transmitted from the printer electronics to a printhead, such as via a flexible cable or other conductors. The printhead (or its carrier, for example) can receive the pair of signals and convert the signals to a single data signal for use by other components in the printhead. To receive and convert the signals, the printhead or carrier can include a current sense circuit, a current amplification circuit, a current to voltage (I/V) circuit, and a CMOS output circuit.

As mentioned, the receiver circuits can be provided on a printhead cartridge or carrier, and can be part of an integrated circuit on the same. These circuits or other appropriate current receiving circuitry, can be provided for each two differential current signal lines to be received from the printer electronics and representing a data level. Each signal to be provided to the printhead can thus be carried by a pair of conductors as a differential current pair. This receiving circuitry on the printhead can then convert the pair of currents to a CMOS voltage. The output voltage Vout can then be used as it typically would be on a printhead, such as by supplying it to latch circuitry, logic circuitry, memory circuitry and driver circuitry to drive a print actuator element. Suitable circuitry for addressing actuators and transferring serial print data through a printhead is disclosed in U.S. Pat. Nos. 6,547,356 and 6,312,079, the relevant disclosures of which are hereby incorporated herein by reference.

Figure 3:
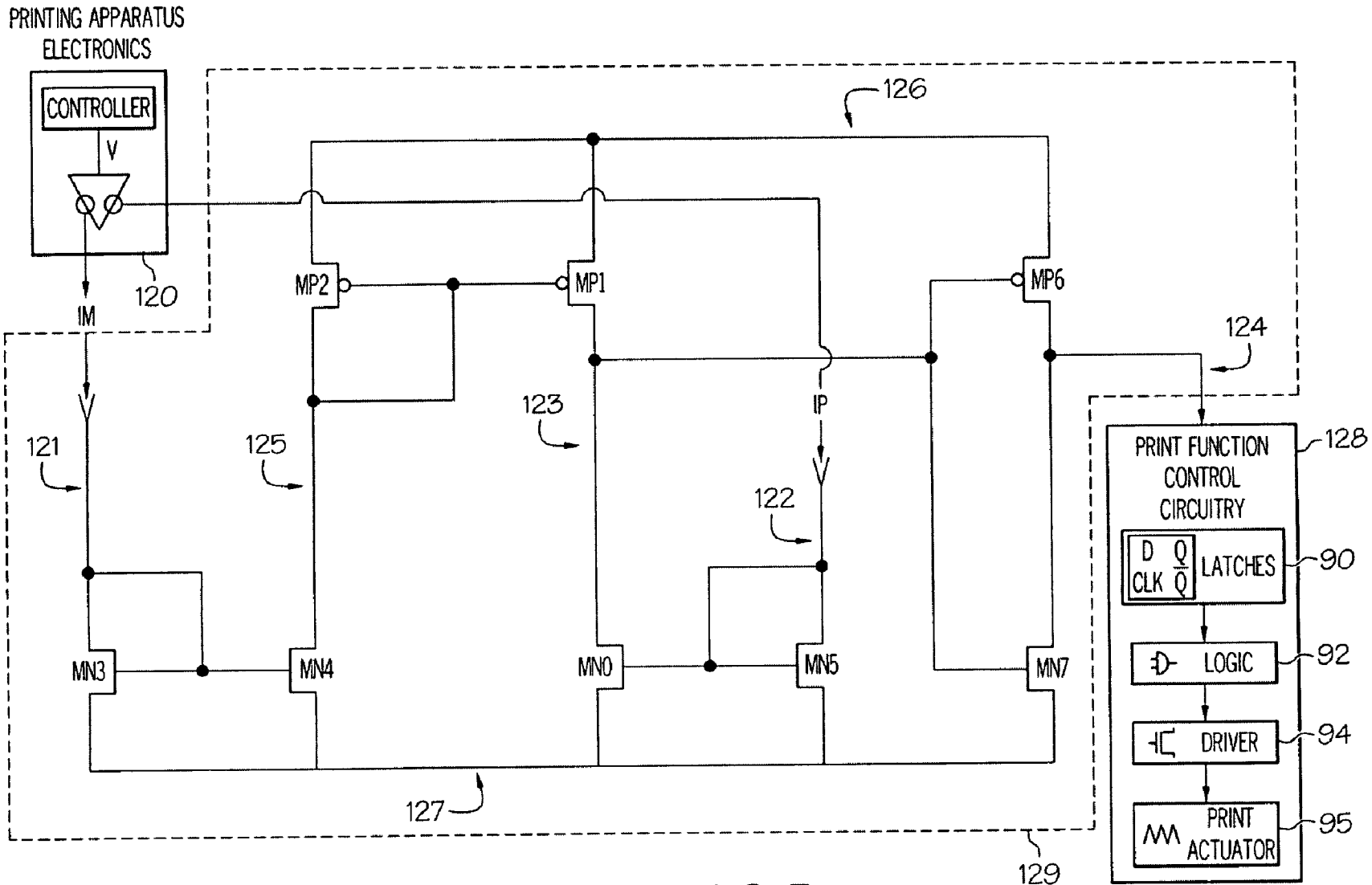
FIG. 3 is a circuit diagram of a micro-fluid ejection apparatus having differential current communication and ejection circuitry according to one embodiment.

For example, FIG. 3 is a circuit diagram of a printing apparatus system having differential current communication and printing circuitry according to one embodiment. The system can include a CTL receiver circuit 129 having Mosfet transistors, which are labeled MN# or MP# and refer to NMOS and PMOS devices respectively. Power can be supplied at node 126 and ground applied at node 127. In this example, input current nodes 121 and 122 have currents IM and IP flowing into diode connected devices MN3 and MN5 respectively. The input currents can be current transfer logic differential currents from printing apparatus electronics. Transistors MN3 and MN4 form a current mirror as do transistors MN5 and MN0 each with a gain of one. Each pair could also have current gain introduced by composing devices MN4 and MN0 to be integer multiples of MN3 and MN5. Transistors MP2 and MP1 of this example form a current mirror such that the current in MP2 is mirrored in transistor MP1. Thus at node 123 a current of IM enters via MP1 and a current of IP leaves via MN0. The difference of these currents charge or discharges the voltage at node 123. If IP is greater than IM then the voltage falls and if IM is greater than IP then the voltage rises. Moreover, transistors MP6 and MN7 of this example form a CMOS inverter that provides gain and output voltage drive at node 124. The output at node 124 can thus be provided to print function control circuitry 128 for control of a printing function. The circuitry 128 can include appropriate latch circuitry 90, logic circuitry 92, and/or driver circuitry 94 which selectively cause activation of an actuator 95. The receiver circuit 127 and circuitry 128 can be separate from the printing apparatus electronics 120. For example, circuitry 127 and 128 can be located at a printhead while electronics 120 can be located on a separate control board, such as described above for instance.

Figure 4:
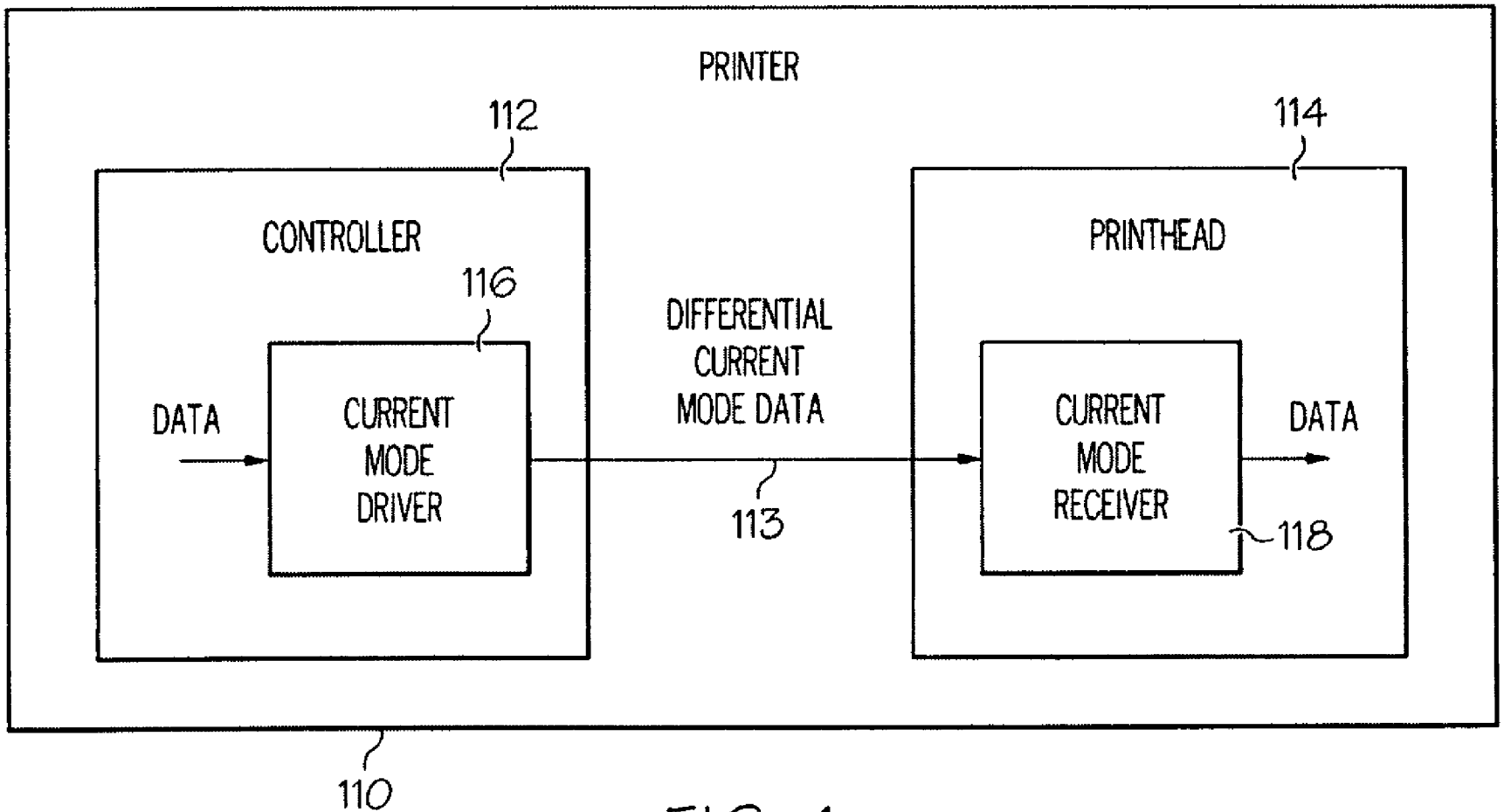
FIG. 4 is a block diagram of a printing apparatus in the form of a printer having differential current communication according to one embodiment.

FIG. 4 is a block diagram illustrating one embodiment where differential current mode data is transmitted between a controller in a printer and a printhead in the printer. In this embodiment, the printer 110 can include a controller 112 and a separate printhead 114 which communicate via a communication line 113. The controller 112 can control functions of the printer and provide command data to the printhead 114 to control the printing operation. The controller 112 may comprise a circuit board, integrated circuit, processor or other circuitry located at a first location in the printer. At a second location at some distance from the controller 112 is a printhead 114, which receives the data from the controller 112 via the communication line 113 and carries out the printing operation according to the data received. The communication line 113 can comprise a ribbon connector or other cabling, wiring, or communication path between the controller 112 and the printhead 114. The line 113 can carry the data as differential current (e.g., via two lines have corresponding amperage levels offset from a base amperage level) from the controller 112 to the printhead 114. To carry out the communication, a current mode driver 116 can be provided within the controller 112 to transmit the data to be communicated from a first form (e.g., a voltage), to a differential current signal. On the printhead 114, a current mode receiver 118 can be provided which can then decode the current signals and provide them as data to the rest of the printhead components for controlling of printing on a media.

The foregoing description of various embodiments and principles of the inventions has been presented for the purposes of illustration and description. It is not intended to be exhausted or to limit the inventions to the precise form disclosed. Many alternatives, modifications and variations will be apparent to those skilled in the art. For example, some principles of the inventions may be used with different types of printers, printing devices, printheads, materials, and circuit elements. As another example, although embodiments use differential currents, other currents or current mode signals can be utilized. Moreover, although multiple inventive aspects and principles have been presented, these need not be utilized in combination, and various combinations of inventive aspects and principles are possible in light of the various embodiments provided above. Accordingly, the above description is intended to embrace all possible alternatives, modifications, aspects, combinations, principles, and variations that have been discussed or suggested herein, as well as all others that fall within the principles, spirit and broad scope of the inventions as defined by the claims.

What is claimed is:

1. A method for communicating in a micro-fluid ejection apparatus, the method comprising:

producing a data signal having at least two logic levels;

converting the data signal to a current signal using a differential current transmitter defining each of the at least two logic levels with differing amounts of current;

transmitting the current signal over a conductor;

receiving the current signal from the conductor;

with a differential current receiver, converting the current signal to a second data signal by sensing the current signal and providing a second current signal based thereon; and generating a voltage signal based upon the second current signal, wherein the voltage signal corresponds to the at least two logic levels with differing voltage levels each having a common current and the apparatus is configured to operate on the second data signal.

2. The method as recited in claim 1, wherein the micro-fluid ejection apparatus is configured to jet ink in response to the second data signal, and wherein the current signal comprises a current transfer logic signal.

3. The method as recited in claim 1, wherein the micro-fluid ejection apparatus is configured to perform at least one of reading or writing to memory in response to the second data signal.

* * * * *